US009027446B1

(12) United States Patent
Simkin et al.

(10) Patent No.: US 9,027,446 B1
(45) Date of Patent: May 12, 2015

(54) WRENCH ADAPTOR

(71) Applicant: Scientific Components Corporation, Brooklyn, NY (US)

(72) Inventors: Gennady Simkin, Brooklyn, NY (US); Behnam Tabrizi, Harvard, MA (US); Harvey L. Kaylie, Great Neck, NY (US)

(73) Assignee: Scientific Components Corporation, Brooklyn, NY (US)

( * ) Notice: Subject to any disclaimer, the term of this patent is extended or adjusted under 35 U.S.C. 154(b) by 221 days.

(21) Appl. No.: 13/742,545

(22) Filed: Jan. 16, 2013

(51) Int. Cl.
*B25B 13/48* (2006.01)

(52) U.S. Cl.
CPC ..... *B25B 13/481* (2013.01)

(58) Field of Classification Search
CPC ..... B25B 13/481
USPC ..... 81/121.1, 124.2, 124.7, 125.1, 177.5
See application file for complete search history.

(56) References Cited

U.S. PATENT DOCUMENTS

| | | | | |
|---|---|---|---|---|
| 798,325 | A | 8/1905 | Daddysman | |
| 4,027,558 | A | 6/1977 | Fish | |
| 4,227,429 | A | 10/1980 | Bowers et al. | |
| 4,846,714 | A | 7/1989 | Welsby et al. | |
| 5,152,196 | A | 10/1992 | Garrett | |
| 5,218,891 | A | 6/1993 | Olson et al. | |
| 6,210,221 | B1 | 4/2001 | Maury | |
| 6,308,596 | B1 | 10/2001 | Williams | |
| 6,725,747 | B2 * | 4/2004 | Erwin | 81/124.2 |
| 6,769,334 | B1 | 8/2004 | Whitehead et al. | |
| 6,817,272 | B2 | 11/2004 | Holland | |
| 6,844,738 | B2 | 1/2005 | Kreager et al. | |
| 6,863,564 | B2 | 3/2005 | Kreager et al. | |
| 7,080,581 | B2 | 7/2006 | Reese | |
| 7,112,970 | B2 | 9/2006 | Kreager et al. | |
| 7,143,670 | B2 | 12/2006 | Geary | |
| 7,347,129 | B1 | 3/2008 | Youtsey | |
| 7,475,619 | B2 | 1/2009 | Chiou et al. | |
| 7,581,471 | B2 | 9/2009 | Chiu et al. | |
| 7,946,199 | B2 | 5/2011 | Bradley | |
| 7,975,578 | B2 | 7/2011 | Youtsey | |
| 8,016,612 | B2 | 9/2011 | Burris et al. | |
| 8,065,940 | B2 | 11/2011 | Wilson et al. | |
| 8,205,529 | B1 | 6/2012 | Laurie | |
| 2004/0035260 | A1 * | 2/2004 | Adkison | 81/124.2 |
| 2005/0284269 | A1 | 12/2005 | Hung | |
| 2008/0047402 | A1 | 2/2008 | Lin | |
| 2008/0121073 | A1 * | 5/2008 | Williams | 81/121.1 |
| 2009/0178517 | A1 * | 7/2009 | Forrester | 81/124.2 |
| 2010/0282031 | A1 * | 11/2010 | Takeda et al. | 81/124.2 |

OTHER PUBLICATIONS

Photographs of the tool distributed by AntennaTek, Inc. 425 South Bowen Street, Longmont, Colorado 805501. KCR Products "SMA (5/16) Torque Wrench" Date of publication not available.

* cited by examiner

*Primary Examiner* — David B Thomas
(74) *Attorney, Agent, or Firm* — Lawrence G. Fridman

(57) ABSTRACT

The wrench adaptor of this invention provides an easy and convenient tool for connection and disconnection of the SMA connections in constrained spaces while allowing use of a standard torque wrench or just fingers. The channel design of the wrench adaptor, accommodating the cable and the protective sleeve therefor, allows access to SMA connectors without bending or disturbing semi-rigid or rigid cables. The wrench adaptor is shown in two embodiments—a single-ended and a double-ended form. The adaptor facilitates access to the hexagonal nut at the panel of an RF device which is mounted to a threaded stud and offsets the wrench application to a location away from the panel. As many of the RF cables have crimped or soldered portions adjacent or within the connector, provision is made in the adaptor by way of a hollow semicylindrical form to cradle the semi-rigid or rigid cable.

17 Claims, 4 Drawing Sheets

WRENCH ADAPTOR

BACKGROUND OF THE INVENTION

1. Field of the Invention

This invention relates to a combination tool, namely a wrench adaptor, usable either as a manually operated tool or as a tool adaptor usable with a wrench or a torque wrench. The wrench adaptor is especially designed to ease connect and disconnect of the subminiature, version A (SMA) connections in constrained spaces while allowing manual operation or the use of a standard torque wrench. The channel design of the wrench adaptor accommodating the cable allows access to SMA connectors without the need for bending or moving the cables thus protecting the coaxial cables and connectors therefor. The adaptor protects rigid and semi-rigid radio frequency (RF) cables during installation and removal and moves the application of rotational forces—whether by hand or by wrench—away from the faceplane of the mounting panel. More particularly, the invention pertains to a tool suited for use with high density, miniature RF connectors.

2. Description of the Prior Art

RF shielded connections to and from RF devices/components to RF test equipments/RF systems are commonly achieved by use of RF shielded cables with SMA connectors. The cable connection to the RF devices/components and/or to RF test equipment/RF systems is achieved by use of SMA male and female mating connectors which are already a part of the cables and the connection points.

The cables, more accurately referred to as "coaxial" or "shielded" cables, have a portion of the structure crimped or soldered to the connector, which connection usually is protected by a sleeve adjacent to and external to the connector. The protective sleeve is, in turn, shrink fitted and renders the cable end proximal to the SMA connector either semi-rigid or rigid. In the prior art, the installation connection is completed by using a torque wrench to tighten the nut, with the inside threads at the end of the male SMA connector, to the outside threads connector at a specific torque level. The number of cables and connections limit the space between connection points thus not allowing, or making it very difficult, to get wrench access to individual connection points for connection or disconnection.

The novelty and usefulness of the improved wrench action of the present invention is further enhanced because of the adoption by the microwave components industry of standardized RF accessories. Historically, the standardization was led by military specifications and later by industry standards. The wrench adaptor is used with standardized SMA connectors for coaxial cables as set forth in the Military Specifications—MIL-C-39012, now MIL-PRF-39012. The presently presented wrench adaptor accommodates the standard size cables, supporting the most popular size cable (8 mm) as well as the smaller 6.35 mm and larger up to 12 mm size cables and all cables therebetween. The flexibility of the wrench adaptor provides a single tool adapted to serve multiple coaxial cable connectors.

U.S. Pat. No. 7,080,581 discloses a tool provided for use with the connectors in high density environment. The internal area of this tool has a relatively narrow slot making it difficult to position and align the cable, especially when it is bent in the rear adjacent the male coaxial cable connector. The distal end of this prior art tool is occupied by a torque applying and torque limiting mechanism which requires the cable to exit the receiving channel in the middle portion of the tool and to form a bend in the cable. This tool is adapted to accommodate cables of relatively small diameter. In view of the restricted access to the inner space of the tool, it might be difficult to apply this tool to semi-rigid and rigid cables and to cables having exterior protective sleeves.

U.S. Pat. No. 7,946,199 discloses a coaxial cable connector rotation aid. Such connector nut rotation aid is for use with manual installation and improves the manual rotation of the threaded nut required to securely connect a coaxial connector with a coaxial cable port or device without the use of a wrench. This device fails to improve installation in areas of high density cabling. Another manual use F-type connector is disclosed in U.S. Pat. No. 6,817,272. This F-Type Connector Installation and Removal Tool accommodates limited bending of the cable at the installation site, however the size of the tool and its proximity to the connection area limits its use in high density areas.

Other prior art modified wrench devices, such as those represented in U.S. Pat. Nos. 4,227,429 and 5,152,196, provide assistance in areas where interconnection points are located in difficult to reach locations. These devices, however, are unable to assist with SMA connections because the devices lack the ability to cradle the cable within the device.

Accordingly, there is a current need for a simple, reliable and inexpensive tool for connecting and disconnecting SMA connectors that is operable in confined spaces and provides for setting the desired torque. There is also a need for a tool capable of (1) accommodating cables of various diameters; (2) operating to provide the torque required for the installation or removal of the connector; and, (3) during operation, maintaining semi-rigid and rigid cables in a static, protected condition. Such a tool should be usable in high density environments to properly torque each connector. Also the tool needs to be cost effectively manufactured in a variety of sizes for use with different standard hexagonal nut sizes.

SUMMARY

The present invention offers convenience and ease to connect and disconnect the SMA connections in the constrained spaces while allowing use of standard torque wrench or just fingers. The channel design of the wrench adaptor, accommodating the cable and, where applicable, the protective sleeve therefor allows access to SMA connectors without bending or disturbing semi-rigid or rigid cables. By use of the wrench adaptor of the invention, connection or disconnection of SMA connectors can be accomplished in any order. Also, as the wrench adaptor reduces the required space to gain access to the SMA connections, system designers are able to utilize the available space more efficiently.

The wrench adaptor hereof is shown in two embodiments, namely, a single-ended and a double-ended form. In both forms, the wrench adaptor is for use with a wrench in the installation of and the removal of a semi-rigid or rigid cable and the associated connector. The adaptor facilitates access to the hexagonal nut at the panel of an RF device which is mounted to a threaded stud and offsets the wrench application to a location away from the panel. As many of the RF cables have crimped or soldered portions adjacent or within the connector, provision is made in the adaptor by way of a hollow semicylindrical form to cradle the semi-rigid or rigid cable.

The wrench application site is at a wrench seat on the exterior of the adaptor and spaced away from the panel between two halves of a split knob which halves act as axial limiters. The axial limiters prevent slippage of the wrench along the longitudinal axis of the adaptor. In use, the wrench can apply a rotational force to the hexagonal nut without transmission loss and without disturbing the cable.

In the single-ended wrench adaptor one end is formed into an open box wrench head and, in the double-ended wrench adaptor, both ends of the adaptor have an open box wrench head.

It is an object of the present invention to provide a tool for facilitating the attachment and removal of a SMA connector with a cable attached thereto to and from an RF device wherein the space between adjacent connectors and nearby structures is severely limited.

It is a further object of the invention to provide a tool meeting the above objective and operable for applying a more secure attachment of connectors than can be achieved using only the prior art tools.

Other objects and features of the invention will become apparent upon review of the drawings and the detailed description.

BRIEF DESCRIPTION OF THE DRAWINGS

In the following drawings, the same parts in the various views are afforded the same reference designators.

DETAILED DESCRIPTION OF THE INVENTION

Figure 1:
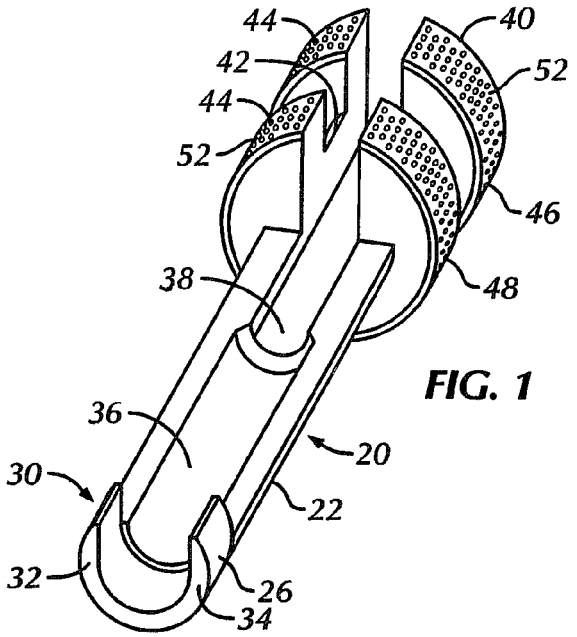
FIG. 1 is a perspective view of the wrench adaptor of this invention as viewed along the cable race thereof.

In general terms, the wrench adaptor of this invention is used with radio frequency (RF) coaxial cables, especially rigid and semi-rigid subminiature, Version A, (SMA) cables. The wrench adaptor enables convenient connection and disconnection by cradling the rigid or semi-rigid cable in a static condition while turning and while torquing the hexagonal connecting nut. Because the internal crimp or solder attachment within the SMA connector is fragile, maintaining the static condition is of high importance.

The wrench adaptor is used in the installation of and the removal of the cable and the cable connector therefor and moves the site of the wrench application and of the torque loading away from the faceplane of the panel without bending or, in any other way disturbing the SMA cable.

Referring now to FIGS. 1 through 6, the preferred embodiment of a wrench adaptor, generally indicated by the reference designator 20, is shown. The wrench adaptor 20 is constructed with a semicylindrical, hollow body 22 which is elongated and of integral construction. In a cross sectional view, the adaptor 20 is C-shaped and has a stepped interior surface 24, described in detail hereinbelow, and an exterior surface 26.

Figure 5:
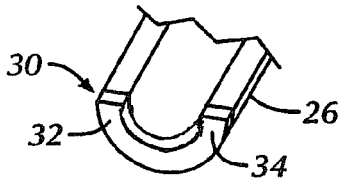
FIG. 5 is a perspective view showing in greater detail the open box wrench head at the proximal end of the wrench adaptor of this invention.
Figure 2:
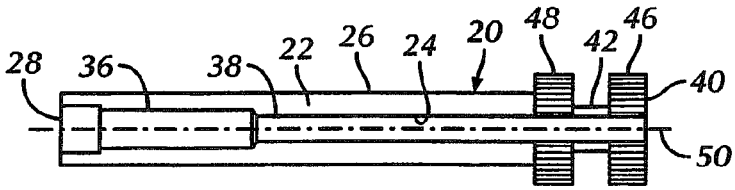
FIG. 2 is a top plan view of FIG. 1.
Figure 3:
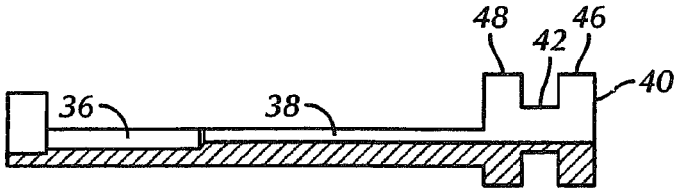
FIG. 3 is a cross sectional view of the wrench adaptor of this invention taken along the centerline shown in FIG. 2.
Figure 6:
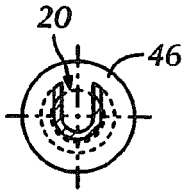
FIG. 6 is a cross sectional view of the wrench adaptor of this invention taken at the wrench receiving slot.
Figure 4:
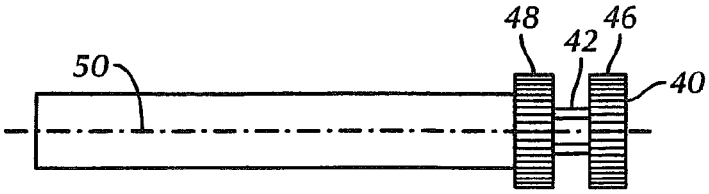
FIG. 4 is a bottom plan view of FIG. 1.
Figure 8:
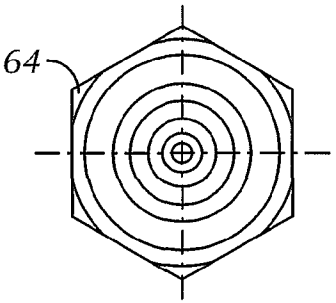
FIG. 8 is an end elevational view of the standard fitting for panel mounting of the plug connector of FIG. 7 and receives the wrench adaptor portion shown in FIG. 5.

The front end or proximal end 28 is configured with an open box wrench head 30 portion with jaws 32 and 34 (shown in greater detail in FIG. 5). In the preferred embodiment, the jaws are set apart 0.318 in. to accommodate the standard 5/16 in. hexagonal nut—a standard SMA attachment hardware size. With precision spacing of the jaws 32 and 34 the endplay in use is limited to 0.003 in (approx.).

In SMA coaxial cables, the attachment end is semi-rigid or rigid and at the location adjacent the hexagonal nut, are equipped with a protective sleeve. To cradle the protective sleeve (shrink-fitted to the cable), the interior surface 24 is dimensioned at the first stepped portion 36 to accommodate the cable with the protective sleeve. Moving rearwardly, the interior surface 24 is dimensioned at the second stepped portion 38 to accommodate the cable. In the preferred embodiment, the second stepped portion 38 extends to and through the rear or distal end 40.

At the distal end 40, a wrench seat 42 is disposed on the exterior surface 26. The seat 42 is located in a split knob 44, the two halves of which act as axial limiters 46 and 48. Once the wrench is seated, the limiters 46 and 48 prevent axial slippage along longitudinal axis 50. To facilitate the removal of an SMA connector, the split knob 44 has a knurled surface 52 and, upon overcoming the torque connection and with the coaxial cable cradled in the wrench adaptor 20, the assemblage is safely, manually removable.

Figure 13:
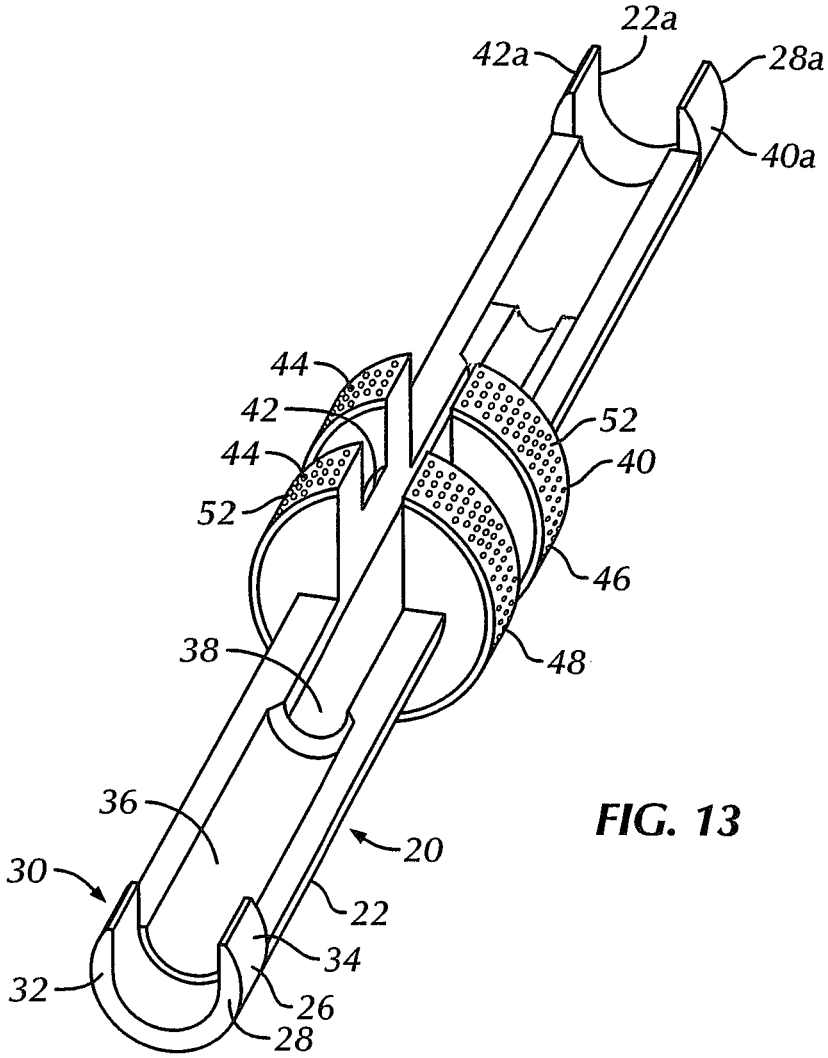

A variation of the wrench adaptor 20 is shown in FIG. 13. This variation includes a second end 28*a*, which is a mirror image of the proximal end 28 with a modified open box wrench head 22*a*. The modified open box wrench head 22*a* includes modified jaws 40*a* and 42*a*. The modified jaws 40*a*, 42*a* are set apart to accommodate an additional standard SMA attachment hardware size. All other components of the wrench adaptor 20, set forth above, are included by reference into FIG. 13. The presently described wrench adaptor 20 accommodates the standard size cables, supporting the most popular size cable (8 mm) as well as the smaller 6.35 mm and larger up to 12 mm size cables and all cables therebetween. The flexibility of the double-ended wrench adaptor provides a single tool adapted to serve multiple cables.

Figure 7:
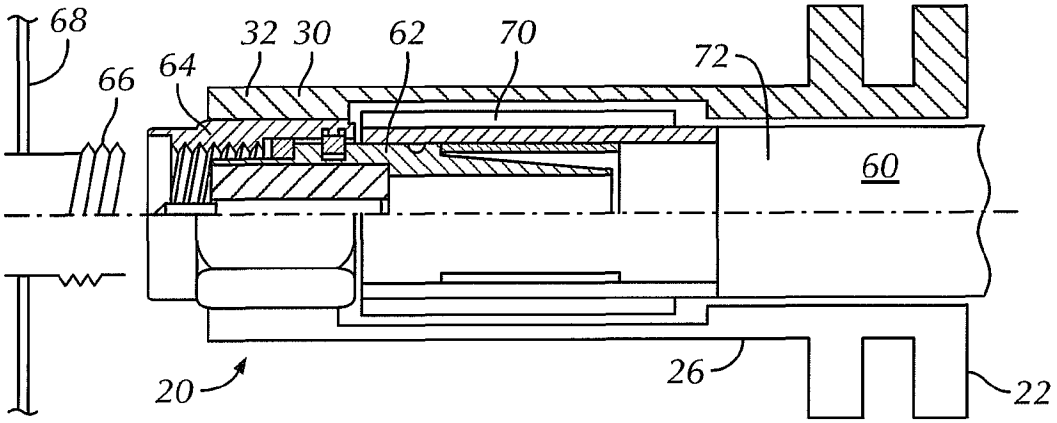
FIG. 7 is a cross sectional view of an SMA cable assembly shown in operation and superimposed on the single-ended wrench adaptor of FIG. 1.
Figure 10:
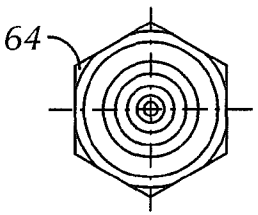
FIG. 10 is an end elevational view of the standard fitting for panel mounting of the plug connector of FIG. 9 and receives the wrench adaptor portion shown in FIG. 5.
Figure 9:
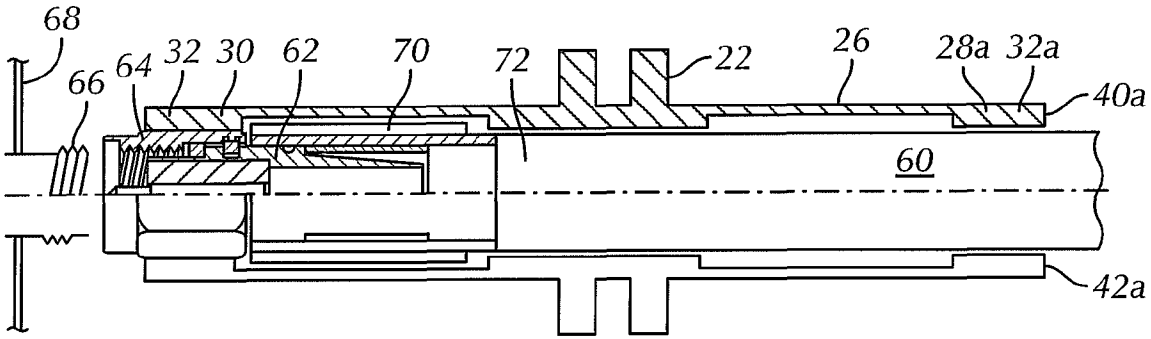
FIG. 9 is a cross sectional view of an SMA cable assembly shown in operation and superimposed on the double-ended wrench adaptor of FIG. 13.
Figure 11:
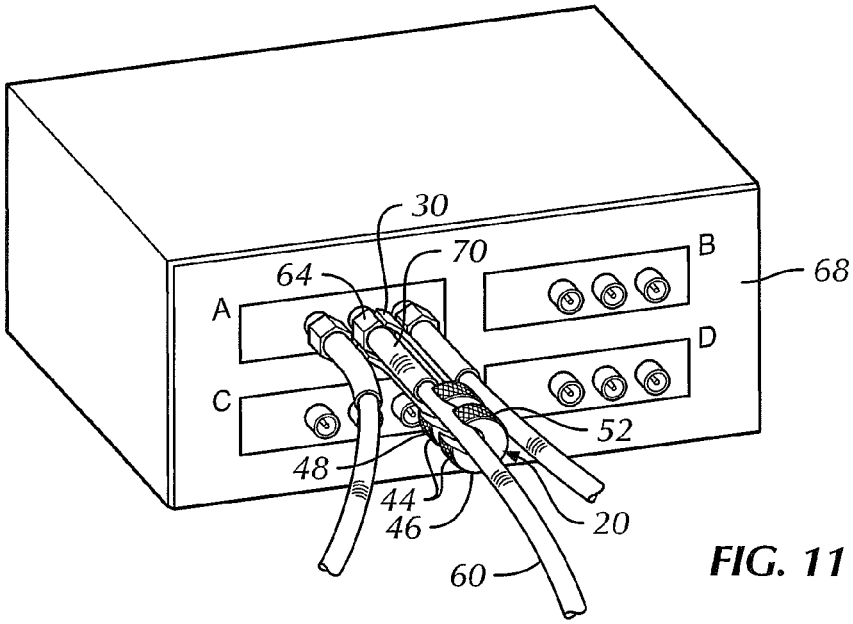
FIG. 11 shows the wrench adaptor in use with a semi-rigid, radio frequency (RF) cable.
Figure 12:
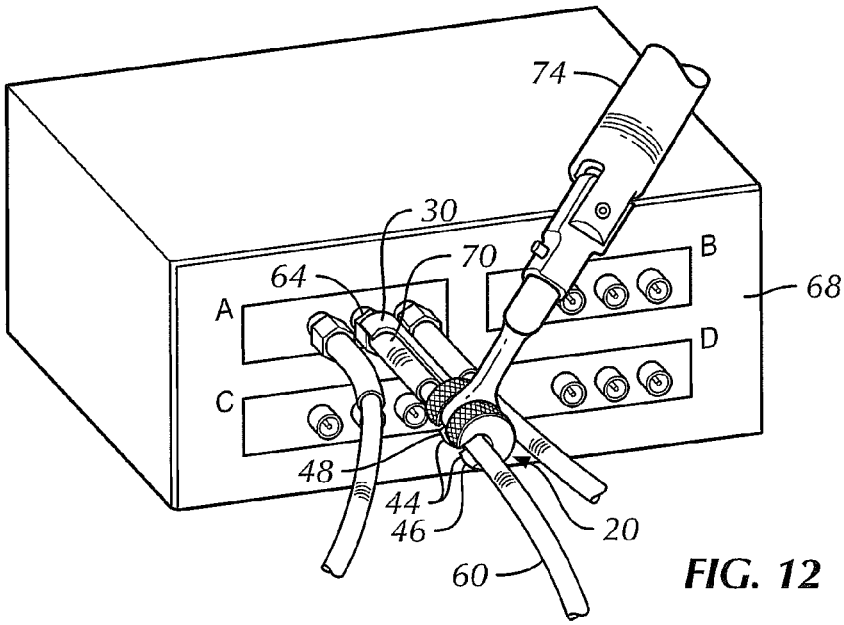
FIG. 12 shows a torque wrench and the wrench adaptor in use with a semi-rigid, radio-frequency (RF) cable; and, FIG. 13 is a perspective view of a double-ended wrench adaptor of this invention.

The operation of the wrench adaptor 20 can best be understood by reference to FIGS. 7 through 12, with FIGS. 7 through 12 showing cross-sectional views of the adaptor in use, and FIGS. 7 and 9 showing views of device panel with the wrench adaptor in place cradling the cable assemblage. In use the wrench adaptor applies a rotational force to the hexagonal nut of the SMA connector from a location spaced away from the faceplate of the device without transmission loss and without disturbing the cable. The device panel views, FIGS. 11 and 12, graphically reinforce the crowded spacing of the connection points and the need for the adaptor.

In operation, the installation of a coaxial cable assembly 60 is first described. The cable assembly 60 includes an SMA connector 62 with a standard hexagonal nut 64 for torqued installation to threaded stud 66 protruding from panel 68. The open box wrench head 30 is slid onto the hexagonal nut 64 with the protective sleeve 70 and cable 72 cradled within the corresponding regions 36 and 38 of the semicylindrical, hollow body 22. The open box wrench head 30 has a pair of jaws 32 and 34 spaced apart to accept the hexagonal nut of the connector with substantially no end play. The split knob 44 is rotated in a direction to screw the nut 64 onto the respective threaded stud 66 while maintaining the protective sleeve 70 and cable 72—the semi-rigid or rigid portion of the cable assembly—in a static, protected condition.

During installation and/or when a specified torque is required, a torque wrench 74 is then emplaced in the wrench seat 42 and the requisite torque is applied to the SMA connector 62. The wrench seat 42 located between the axial limiting portions 46 and 48 is structured to prevent any wrench slippage along longitudinal axis 50 of the wrench adaptor 20.

The removal of a coaxial cable assembly 60 is next described. The open box wrench head 30 is slid onto the hexagonal nut 64 with the protective sleeve 70 and cable 72 cradled within the corresponding regions 36 and 38 of the semicylindrical, hollow body 22. Using the wrench adaptor 20 and applying a rotational force at the split knob 44—positioned away from panel 68—the hexagonal nut 64 is rotated in a direction to unscrew the nut 64 from stud 66. Usually the torque loading of the assemblage, is overcome manually; however, an external wrench may be used, if required, at the wrench seat 42 of split knob 44. During the disassembly the semi-rigid or rigid portion of the cable assembly is protected by maintaining the protective sleeve 70 and cable 72—the semi-rigid or rigid portion of the cable assembly 60—in a static, cradled condition.

It should be obvious from the above the invention provides a wrench adaptor for convenient connection or disconnection of the SMA and other types of connectors and can provide access to SMA connections in tight spaces. It reduces possibility of torque wrench slippage. The wrench adaptor of the invention is a smaller and lighter tool to carry around as compared to the traditional torque wrenches.

While particular embodiments of the present invention have been illustrated and described, it would be obvious to those skilled in the art that various other changes and modifications can be made without departing from the spirit and scope of the invention. For example, the wrench head provided at the distal end of the wrench adaptor can be also adapted for engagement with hex nuts of SSMA, SMC and other types of high density connectors. The torque portion provided at the distal end of the wrench adaptor can be formed with one knurled member, instead of two members discussed in the application.

What is claimed is:

1. A wrench adaptor for use with a wrench in the installation of and the removal of a cable and a connector therefore, the connector mounted to a threaded stud by a hexagonal nut, the wrench adaptor comprising, in combination:

an elongated body being a hollow semi-cylindrical form having, in cross-section, a C-shaped wall with an interior surface and an exterior surface;

a wrench seat disposed on the exterior surface of the wall of the elongated body;

a pair of axial limiters, one of the pair of axial limiters disposed on each side of the wrench seat to prevent axial slippage of the wrench;

a slot extending longitudinally throughout the elongated body dimensioned to cradle the cable during the installation and during the removal thereof;

whereby a rotational force is applicable to the hexagonal nut without transmission loss and without disturbing the cable.

2. The wrench adapter as in claim 1, wherein at least one end thereof has an open box wrench head.

3. The wrench adaptor as in claim 2, wherein each end has an open box wrench head.

4. The wrench adaptor as in claim 2, wherein the open box wrench head has a pair of jaws spaced apart to accept the hexagonal nut of the connector with substantially no end play.

5. The wrench adaptor as in claim 4, wherein the entryway of the open box wrench head and the entryway into the slot are substantially aligned thereby allowing the simultaneous sliding of the open box wrench head onto the hexagonal nut and the cradling of the cable in the hollow of the wrench adaptor.

6. The wrench adaptor as in claim 5, wherein the cable further includes a protective sleeve adjacent the juncture thereof with the connector, the wrench adaptor further comprising a first slot portion extending longitudinally from the open box wrench head dimensioned to accommodate the cable and the protective sleeve in the hollow of the elongated body and a second slot portion extending longitudinally from the first slot portion, the second slot portion dimensioned to accommodate the cable in the hollow of the elongated body.

7. The wrench adaptor as in claim 1, wherein a pair of axial limiters are knurled to facilitate manual operation of the wrench adaptor.

8. The wrench adaptor as in claim 7, wherein the pair of axial limiters are spaced by a predetermined dimension to permit the insertion of and engagement with an open box wrench head of the wrench, the spacing precluding axial slippage of the wrench.

9. A torque wrench extender for applying a selected torque setting to a radio frequency (RF) coaxial cable fitting, the fitting mounted on a panel in a closely assembled array utilizing standard subminiature version A (SMA) connectors to a semi-rigid or rigid cable, the torque wrench extender comprising:

a hollow elongated body with a slot extending longitudinally from one end thereof to the other, the slot in the wall of the elongated body and dimensioned to slidably receive therealong and to insert into the hollow elongated body the semi-rigid cable, the wrench extender thereupon enabled to rotate about the semi-rigid cable without engaging the same;

an open box head wrench fitting disposed at one end of the hollow elongated body, the fitting contiguous with and aligned with the slot for slidably mounting to the standard plug connector; and a torque wrench receiving portion disposed at the end of the extender opposite the open box head fitting permitting the use of a torque wrench to provide a specified torque load; a pair of knobs is disposed at the torque wrench receiving portion, the knobs are spaced by a predetermined distance to permit insertion of a head of the torque wrench.

10. The torque wrench extender as in claim 9, wherein the end play at the open box head fitting is less than 0.003 in.

11. The torque wrench extender as in claim 9, wherein the pair of knobs have a knurled surface for facilitating manual operation thereof.

12. The torque wrench extender as in claim 9, wherein said head is an open box wrench head, and the spacing between the knobs precludes axial slippage of the torque wrench.

13. A subminiature Version A (SMA) plug connector tool for installation and removal of a cable and connector therefor, the tool for use in conjunction with a torque wrench for applying a specified torque load to a standard cable and a connector therefore, the tool comprising:

an elongated body having a wall surrounding a hollow core, the elongated body comprising;

an open box head portion disposed at a proximal end thereof;

an aperture portion in the wall of the elongated body extending longitudinally along the tool permitting the cable to be slidably emplaced in the hollow core;

a pair of knurled knobs disposed about the elongated body at a distal end opposite the open box head portion and spaced apart by a predetermined spacing; and a torque wrench receiving portion between the pair of knurled knobs;

whereby, upon mating the tool to the standard cable connector, and upon mounting a torque wrench, a selected torque can be provided.

14. The SMA tool as in claim 13, wherein the predetermined spacing of the knurled knobs precludes axial slippage of the torque wrench.

15. The SMA tool as in claim 13, wherein the open box head portion fits a standard 5/16 inch hexagonal nut.

16. The SMA tool as in claim 15, wherein the cable further includes a protective sleeve adjacent the juncture thereof with the connector, the wrench adaptor further comprising a first slot portion extending longitudinally from the proximal end part way toward the distal end dimensioned to permit the passage of the cable and the protective sleeve into the hollow of the elongated body and a second slot portion extending longitudinally from the distal end to meet the first slot portion, the second slot portion dimensioned to permit the passage of the cable into the hollow of the elongated body.

17. The SMA tool as in claim 16, wherein, upon mounting onto the connector, the tool is rotatable without disturbing the positioning of the cable and the protective sleeve.

* * * * *